United States Patent [19]

Payeur

[11] Patent Number: 4,653,561

[45] Date of Patent: Mar. 31, 1987

[54] LOG DEBARKING MACHINE

[75] Inventor: Marcel Payeur, Plessisville, Canada

[73] Assignee: Forano, Inc., Quebec, Canada

[21] Appl. No.: 765,524

[22] Filed: Aug. 14, 1985

[51] Int. Cl.[4] ..... B27L 1/00

[52] U.S. Cl. ..... 144/340; 144/208 E

[58] Field of Search ..... 144/208 R, 208 E, 340

[56] References Cited

U.S. PATENT DOCUMENTS 3,196,912 7/1965 Brundell et al. ..... 144/208 E 4,122,877 10/1978 Smith et al. ..... 144/208 E

*Primary Examiner*—W. D. Bray

*Attorney, Agent, or Firm*—Cushman, Darby & Cushman

[57] ABSTRACT

The disclosure herein describes improvements to a log debarking machine which consists in allowing the mounting of six debarking tools on the machine rotor which has a central log-passing opening of eighteen inches in diameter. The rotor is arranged with a series of bearing seats for receiving and supporting the tool spindles. The improvements further include a cleaning knife for cutting the bark fiber which adhere to the tools.

18 Claims, 8 Drawing Figures

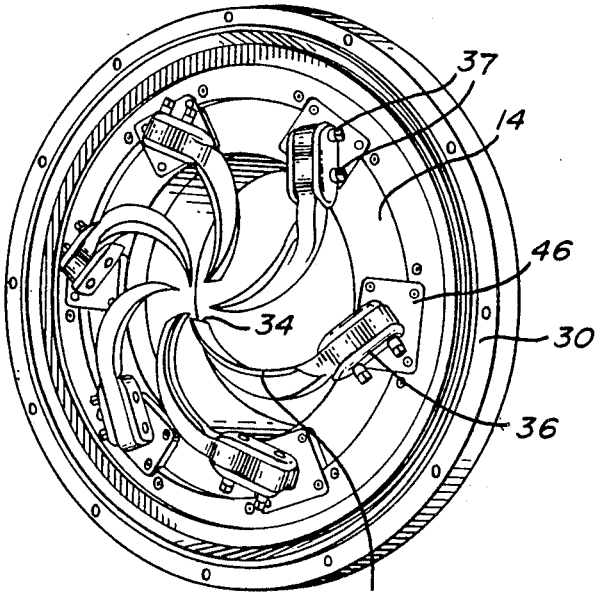
FIG. 2
FIG. 3
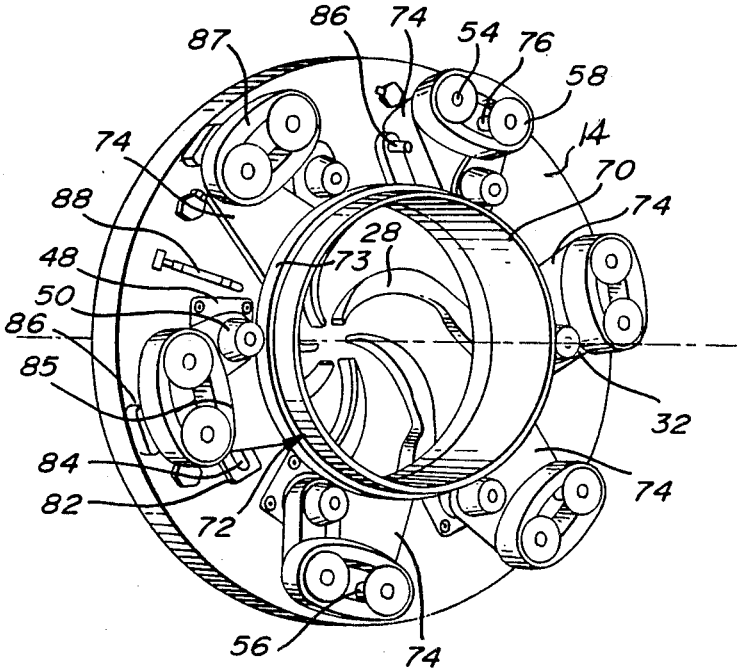

FIG. 8
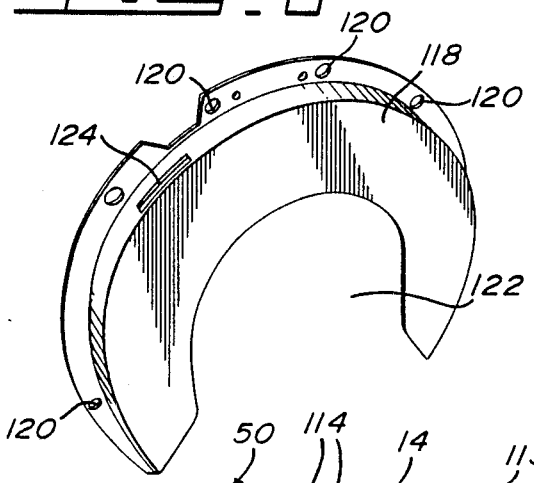
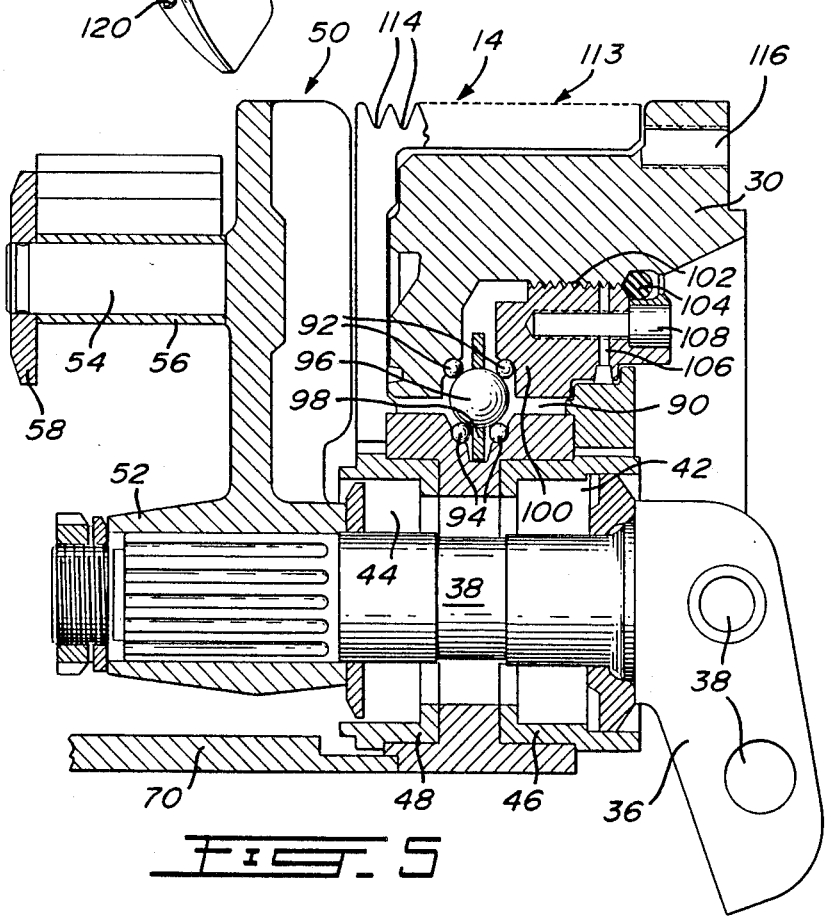
FIG. 5

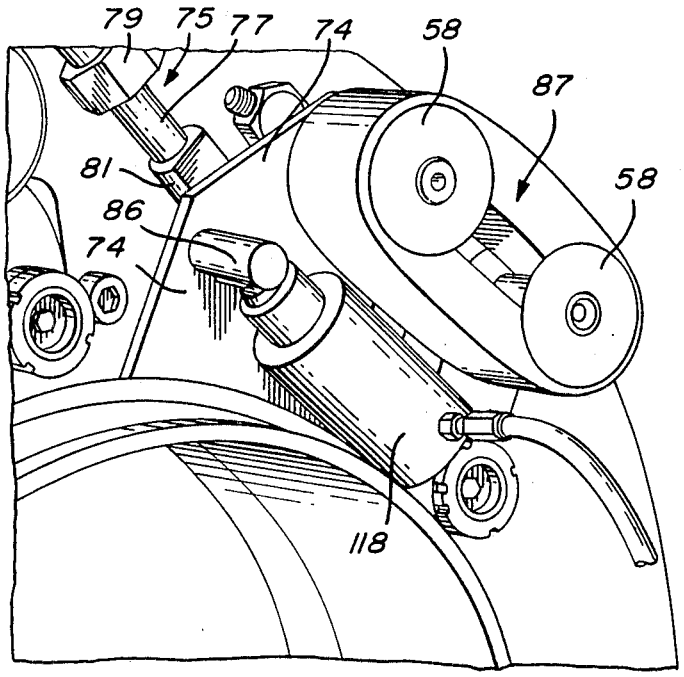
FIG. 6
FIG. 7
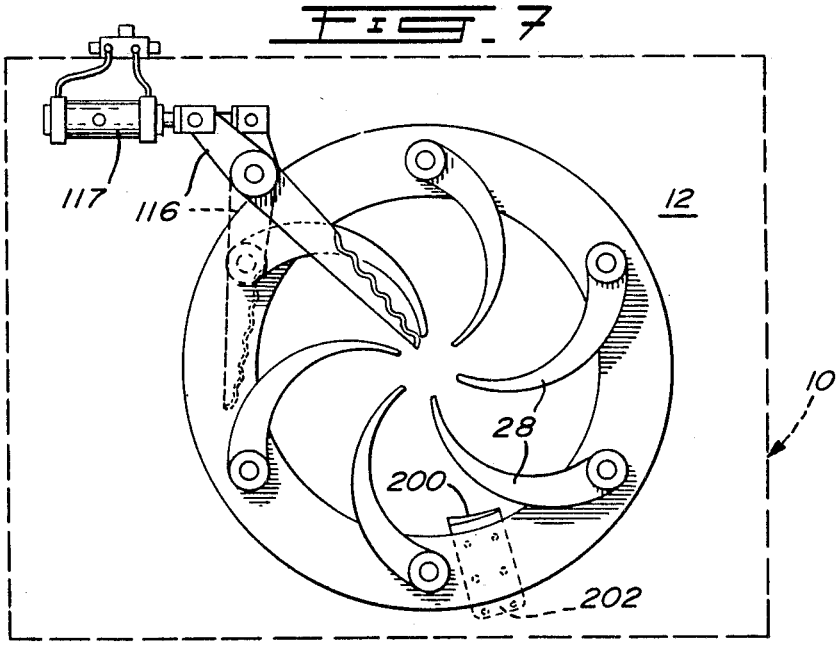

LOG DEBARKING MACHINE

FIELD OF THE INVENTION

The present invention relates to an improvement in a log debarking machine and, more particularly, to such improvement allowing a greater number of debarking tools forming parts of such machine.

BACKGROUND OF THE INVENTION

In recent years, the demand for debarked logs from sawmills and wood-pulp industries has increased substantially. After the branches of a felled tree have been removed, its stem is passed through a machine for removing the bark.

One type of debarking apparatus which is widely used is of the so-called "ring type" (or rotor) through which the log is fed forward while a plurality of bark scraping tools are urged against the log surface. The tools pivot on spindles extending parallel to the axis of rotation of the ring and are spring loaded so as to keep the tips of the tools, when the machine is running idle, in the neighbourhood of the rotor axis.

The machine also comprises a log feed device which automatically holds and advances the log through the rotor. When a log is initially introduced to the machine, it is pressed against the leading edge of the debarking tools which, under the influence of the rotation of the rotor, causes each tool to open against the spring pressure and place the working tip in contact with the outside surface of the log.

As the atmospheric conditions in which these machines operate vary within wide limits, it has been observed that a satisfactory operation cannot be achieved by continuously utilizing the same spring rigidity, on the tools. For example, when the logs are in a frozen state, it is necessary to provide a certain amount of spring pretensioning for firmly pressing the tools against the log surface in order to completely remove the frozen bark. On the other hand, in the summer, a lesser amount of spring pretensioning is necessary since the bark is relatively soft.

For maintaining a satisfactory operation all year long, presently used debarking machines are provided with spring pretensioning devices; an example is given in Canadian Patent No. 675,525 issued Dec. 3, 1963 to Söderhamns Verkotäder AB. This patent teaches an hydraulic spring tensioning assembly constituted by a piston sliding in a cylinder, one assembly being used with every bark scraping tool of the ring. The device, however, suffers from problems inherent to all hydraulic systems, such as leaks, complexity, excessive cost, etc. The major drawback of the tensioning device described in this patent resides in its bulkiness. Due to the cumbersomeness of the tensioning assemblies, the number of tools which may be mounted on the rotor is limited. A rotor with an opening having a diameter of 18 inches, which is a size in great demand can be provided with only five tools. It has been found highly desirable to mount an additional tool to a rotor of such size to increase substantially the debarking operation. However, the mounting of a sixth tool cannot be envisaged on 18-inch diameter rotors since there is simply not enough place for an additional piston-cylinder tensioning assembly.

It should be noted that debarking machines with larger size rotors (from 24 inches in diameter) utilizing six tools, are known. On such rotors, mounting a sixth tool is possible as the available surface for the tools and the tensioning assemblies augment by the square of the radius increase of the rotor. However, up until now, 18 inch rotors have been limited only to five bark scraping tools.

The spindles of the prior debarking machines on which the debarking tools are mounted for pivoting, are received in holes made on the rotor housing adjacent the periphery of the central opening through which the logs are passed. The rotor is usually a casting into which the spindle holes are drilled and bearing seats are machined for receiving the spindle bearings. After a certain period of time, the bearing seats wear out and must be serviced. In such case, the rotor is removed, the bearing seats surfaces remetalized and machined. This is a costly operation and involves a loss of a few production days.

For achieving a high degree of reliability and durability, present debarking machines are provided with a system supplying liquid lubricant to the rotor bearing which needs constant lubrication. A known lubrication system includes a pump continuously recirculating and spraying oil through conduits inside the machine. Another system, also in use, comprises a moving endless chain passing through an oil sump and distributing the lubricant by dripping action.

However, both these lubrication systems have not been found satisfactory from the stand point of reliability as stoppage might pass unnoticed by the machine operator with disastrous consequences. Further, in both systems, the circulated lubricant is contained in a pan into which condensation, dust and impurities accumulate, contaminating the lubricant and rendering it improper for further use.

The rotor of a debarking machine is supported on a bearing whose backlash, or free play must be adjusted from time to time to compensate for the wear. This is achieved by adjusting the pressure on the bearing exerted thereon by an adjusting ring screwed in the stator of the machine which supports the rotor. In the prior art devices, during the adjusting procedure, the ring must be rotated manually and, as it is almost flush with the stator, it offers little hold, rendering the process difficult and time consumming.

In debarking machines of the type under consideration, the rotor is rotated at a relatively high speed and the tools are continuously maintained in contact with the log surface. Therefore, most types of barks are immediately torn to small pieces and and eliminated. However, with some types of wood, the bark is removed from the log in the form of long slivers which have the tendency to adhere to the bark scraping tools impairing the machine operation.

In order to obviate this problem, it has been suggested to utilize a cleaning knife which pivots in front of the rotor transversely of the axis of the latter in the neighbourhood of the tools for cutting apart the back fiber. The clearance space between the knife and the tools must be in the order of ⅛ of an inch for achieving a satisfactory operation. An example of such cleaning knife is given in Canadian Patent No. 584,237 issued Sept. 29, 1959 to Söderhamns Verkotäder disclosing, more specifically, a cleaning knife positioned by the degree of opening of the log feed device of the machine. This system, however, has not been found sucessfull and is no longer in use since the position of the knife relatively to the rotor opening depends upon the position of the log feed device, which is a function of the diameter of the log to be debarked. It has been observed that deformed logs may interfere with the knife and drag it into the plane of rotation of the tools causing extensive damages.

AND STATEMENTS OF THE INVENTION:

It is an object of this invention to provide a log debarking machine of the hollow rotor type with a central opening of about 18 inches in diameter and utilizing size bark scraping tools.

Another object of this invention is to provide a method for pretensioning the springs of the bark scraping tools.

Another object of this invention is to provide a debarking machine, the rotor of which is provided with bearing seats for receiving and supporting the bearings of the tool spindles, the bearing seats being individually replaceable when they become worn.

Another object of this invention is to provide a debarking machine comprising a cleaning knife for cutting the bark fiber adhering to the tools of the rotor wherein the cleaning knife is not likely to interfere with the log being debarked.

Another object of this invention is to provide a lubrication system for the rotor bearing of a debarking machine of the kind described and which is less prone to contamination and mechanical failures.

Another object of this invention is a method for adjusting the rotor bearing backlash, or free play, the method rendering the adjusting procedure easier than in prior art devices.

The objects of this invention are achieved by providing an annular shaped rotor which has a central opening of substantially 18 inches and which comprises a mechanical spring pretensioning mechanism consisting of a frame mounted on the rotor and capable of rotating thereon within close limits. On this frame are attached the tools tensioning springs, whereby when the frame is displaced angularly on the rotor, all the springs are pretensioned simultaneously. Preferably, the frame is rotated by a manually operated hydraulic jack mounted between the frame and the rotor. Also, the latter is provided with relatively simple locking means for fixing the frame in a given position. Such an arrangement occupies relatively little space and allows an additional tool to be mounted to the rotor.

The rotor of the debarking machine is also provided with replaceable bearing seats into which the spindle bearings are received. The bearing seats are retained on the rotor with fasteners, such as bolts. When a bearing seat is to be serviced, it is removed and a new seat is installed. It is no longer necessary to remove the rotor from the machine; hence, maintenance time is substantially reduced.

The lubrication system of the rotor bearing machine according to this invention consists of a grease fitting which is mounted to the rotor and allows grease discharge therein radially inwardly of the bearing. When the rotor is set in motion, the centrifugical force forces the grease to pass to the bearing, providing the necessary lubrication.

Such a lubrication system substantially resolves the problem of lubricant contamination and is not likely to undergo failures since it is constituted by a simple tubing.

The debarking machine, in conformity with this invention, also comprises a rotor cleaning knife pivotally attached to the body of the machine and capable of swinging from a stored position to an operative position wherein it extends in front of the rotor for cutting off the bark fiber adhering to the tools. The knife position is controlled by the operator through a security device (such as a relay or a switch) preventing an accidental actuation of the knife while a log is being debarked. The advantage of this system resides in that, when the knife is placed in a stored position, it is at a certain distance from the rotor opening, which distance is sufficient to prevent any contact with a deformed log fed through the machine. The stored position is fixed and does not depend upon the position of the feed device, as in prior systems.

The present invention also includes a cleaning pipe extending within the central opening of the rotor for scraping accumulated fibers on the circumferential inner wall of the rotor.

For adjusting the free play of the rotor bearing, it is suggested, according to the invention, to utilize a hammering block to be mounted on the rotor when the adjustment procedure is performed. The hammering block comprises a portion which interferes with the head of a bolt on the adjusting ring used to lock it into a given position on the stator. In rotating manually the rotor by grasping the bark scraping tools, the hammering block successively strikes the head of the bolt on the adjusting ring and rotates the latter. Since the rotor offers a reasonably good hold, the free play adjusting procedure is greatly facilitated.

Therefore, the rotor according to this invention comprises, in its most general aspect:

an annular member to be rotated about a first axis, the member comprising a central substantially circular opening of substantially 18 inches in diameter and through which a log is to be passed along said first axis;

a frame mounted on the member and being capable of a limited movement thereon:

a frame locking means mounted on the member and cooperating with the frame for fixing it in a given position relatively to the member;

six bark-scraping tool assemblies equally spaced about the periphery of the opening, each bark scraping tool assembly comprising;

(a) a spindle rotatably mounted to the annular member about an axis substantially parallel to the first axis, the spindle being adjacent to the periphery of the opening;

(b) a crank secured to an end of the spindle;

(c) a spring assembly interconnecting the crank and the frame for urging the crank towards the frame, the spring assembly comprising;

(i) a first spring holding finger mounted to the crank at a distance from a spindle;

(ii) a second spring holding finger mounted to the frame and being substantially parallel to said first spring holding finger; and (iii) at least one belt of rubber-like material mounted around the first and second spring holding fingers, whereby by displacing the frame relatively to the member in order to move the second spring holding finger apart from the first holding finger, the belt is tensioned;

(d) a rigid elongated crescent-shaped tool having an end secured to an opposite end of the spindle and an opposite end provided with a scraping edge, said tool being swingable along a plane substantially normal to the first axis between a first position wherein the bark scraping edge is adjacent to the first axis and a second position wherein the bark scraping edge is adjacent to the periphery of the opening, the first position being limited by stop means mounted on the rotor, the spring assembly urging the tool towards the first position against the surface of the log passed through the rotor by the intermediate of the lever and the spindle.

The debarking machine according to this invention comprises: a rotor of the described construction mounted by means of an external bearing to a fixed body and a log feed device for advancing the logs through the rotor.

The method of this invention according to which the scraping tool's spring are tentioned resides generally in the following steps:

(a) loosening the frame locking means;
(b) mounting the hydraulic jack between the first and second abuttment means;
(c) actuating the jack for forcing the first and second abuttment means apart against the plurality of spring means; and
(d) locking the frame locking means for fixing the frame in the position reached at step (c).

In its most general aspect the method according to this invention, for adjusting the rotor bearing lash, consists of:

(a) loosening the lock bolt of the bearing adjusting ring, without removing the lock bolt;
(b) securing on the rotor a hammering block comprising a portion adapted to interfere with the lock bolt head when the rotor is rotated; and
(c) rotating manually the rotor back and forth and successively stricking the lock bolt head with the hammering block in order to rotate said adjusting ring until the desired degree of pressure on the bearing is reached.

BRIEF DESCRIPTION OF THE DRAWINGS

FIG. 2 is a perspective view illustrating the front of a rotor according to the present invention;

FIG. 3 is a perspective view showing the back of a rotor according to the present invention;

FIG. 5 is a cut taken along lines "A—A" of FIG. 4;

FIG. 6 illustrates the hydraulic jack mounted on the rotor for pretentioning the tool's springs;

FIG. 7 illustrates a schematic view of a debarking machine according to this invention and being provided with a knife for cleaning the tools; and FIG. 8 is a perspective view of a hood for the rotor of a debarking apparatus.

DESCRIPTION OF PREFERRED EMBODIMENTS

Figure 1:
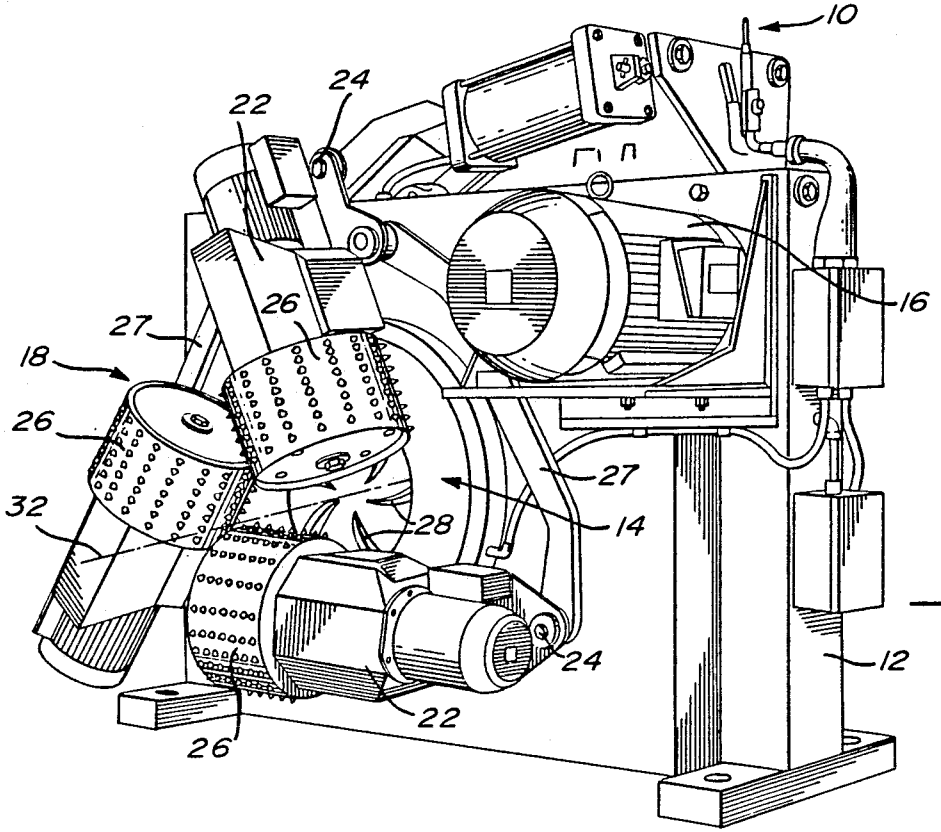
FIG. 1 illustrates a perspective view of a debarking machine.

With reference to FIG. 1, the debarking machine 10 comprises a body 12 into which is mounted rotor 14 adapted to rotate about axis 32. An electric motor 16 of a suitable power rating drives rotor 14 through a belt transmission. Two log fed mechanisms 18 and 20 (not shown) constituting a log feed device are mounted on body 12 respectively on each side of rotor 14.

Each mechanism consists of three driven or freely running rollers 26 arranged in the same plane at right angles to the feeding direction. The rollers are rotatably mounted on arms 22 swingable substantially in a plane at right angles to the log feed direction which corresponds to axis 32, the axis of rotation of the rollers being parallel to this plane. The arms 22 are journaled to the body 12 of the debarking machine 10 and are movable in unison by a linkage 27 for accomodating and holding logs of different diameters. The rollers 26, are also provided with spikes for securely engaging the log surface.

Such a log feed device is described with more details in Canadian Patent No. 536,216 issued on Jan. 22, 1957 to Söderhamms Verkoäder Arktiebolg.

FIG. 2 illustrates the rotor 14 bearing mounted to a stator 30 for rotating about axis 32. Rotor 14 is annularly shaped and carries six crescent shaped bark scraping tools 28 each provided with scraping edge or tip 34. The opposite end of each tool 28 is received into a fork shaped tool holder 36 and is secured therein by means of two bolts 37.

Figure 4:
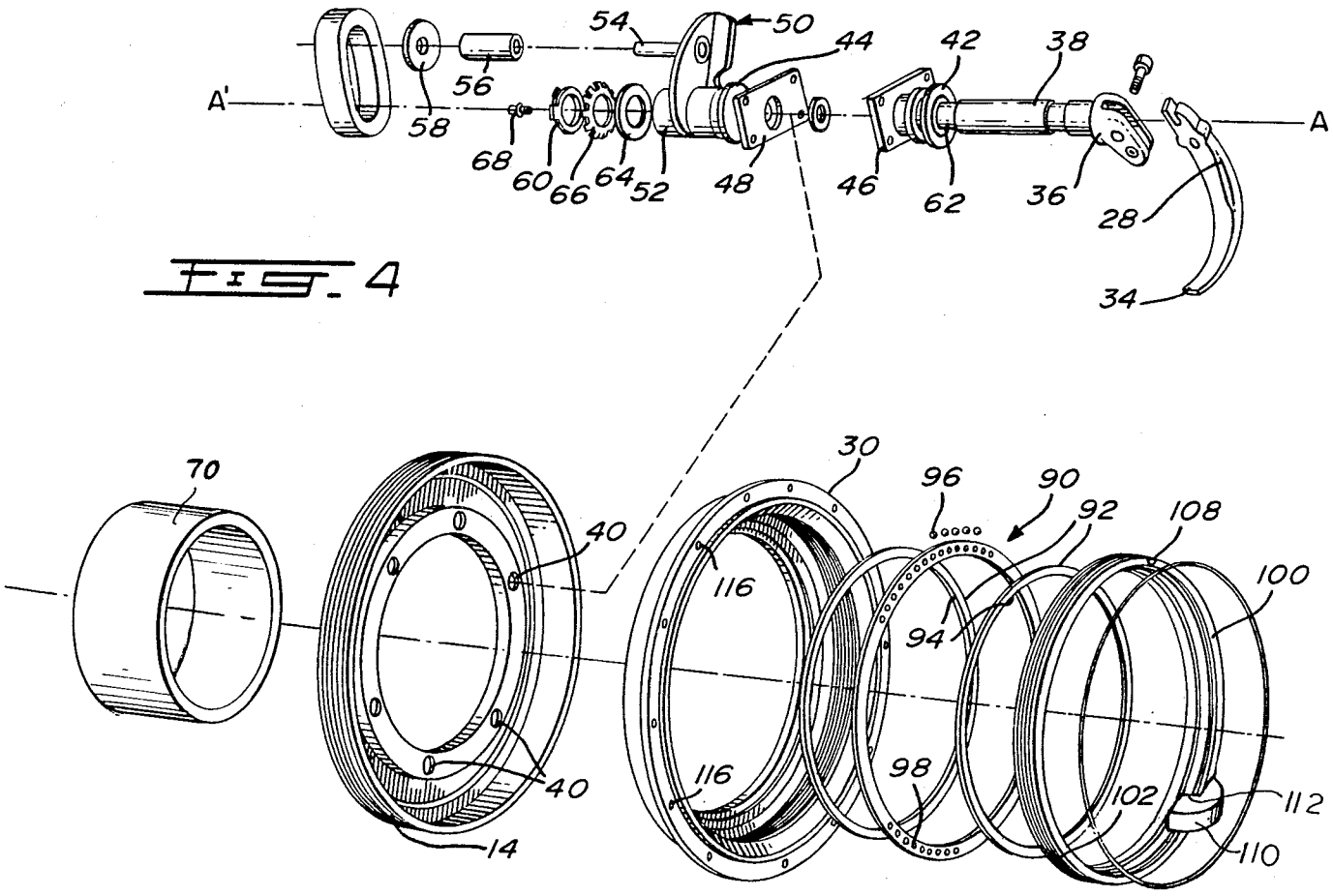
FIG. 4 is an exploded view of a rotor according to the present invention.

With reference to FIGS. 3 and 4, each tool holder 36 is formed at an end of a spindle 38 mounted in a circular hole 40 in rotor 14 for rotating axially therein. Spindle 38 is supported on bearings 42 and 44 which are received in bearing seats, respectively 46 and 48. The bearing seats are mounted coaxially to opening 40 at the ends thereof, and are retained to rotor 14 by machine screws.

On spindle 38 is slidingly mounted a crank 50 provided with a sleeve portion 52 keyed to spindle 38 for preventing a relative rotation therebetween, by an arrangement of longitudinally extending mating grooves and ribs formed on the internal surface of sleeve portion 52 and spindle 38. Crank 50 is secured to spindle 38 by a locknut 60 threadedly engaging an end 62 of spindle 38. Between sleeve 52 and locknut 60, are mounted respectively a washer 64 and a lockwasher 66. A grease-fitting 68 is subsequently screwed to extremity 62 of spindle 38. Crank 50 also comprises a finger 54 parallel to spindle 38 and on which is slindingly received a sleeve 56 and a nylon washer 58.

This arrangement allows tools 28 to pivot in a plane which is normal to the direction of feed of the logs or axis 32.

With reference to FIG. 3, rotor 14 comprises a sleeve 70 which defines a central opening having a diameter of 18 inches and through which the logs are passed after debarking. On sleeve 70 is rotatably mounted a star shaped frame 72 comprising a ring 73 on which are attached six radially extending flanges or arms 74 each being adjacent to a finger 54. At the end of each flange 74 is mounted a pin 76 which is parallel to an adjacent finger 54 and also receives slindingly thereon, a sleeve 56 and a nylon-washer 58. Frame 72 is retained on rotor 14 by a bracket 82 comprising an arcuate slot 84 into which slides a bolt 85 retained on flange 74 of frame 72. The arcuate slot limits the angular movement of the frame relatively to rotor 14 as well as restraining the frame from any substantial axial movement.

A frame locking device 75 (see FIG. 6) comprises bolt 77 engaged in nut 79 welded to rotor 14 and having an end received in a nut 81 attached to a flange 74 of frame 72. Frame locking device 75 is used to fix frame 72 in a given position on rotor 14.

Around each pair of fingers 54 and pins 76 is mounted a spring 87 constituted by three concentric belts of rubber-like material. As illustrated, nylon-washers 58 sit on the belts and hold them in place.

One of flanges 74 includes pin 86 whose function will be explained later.

The rotor is also provided with a grease fitting 88 which is used for lubrification purposes and which will be referenced later.

Springs 87 through the intermediary of fingers 76 and 54 cranks 50 urge tools 28 toward a position wherein the edges 34 are in the neighbourhood of axis 32. This position, which corresponds to the position of tools 28 in FIGS. 2 and 3 is limited by stops 86 associated with every crank 50. The stops 86 are constituted by plates attached to rotor 14 and against which abutt cranks 50.

With reference now to FIGS. 4 and 5, rotor 14 is bearing mounted in stator 30 by a ball-bearing assembly 90 constituted by two concentric rings 92 defining the outer race and two concentric rings 94 defining the inner race of bearing assembly 90. Between rings 92 and 94 are mounted a plurality of steel balls 96 held in a predetermined relative position to each other by a ball distance ring 98.

A bearing adjusting ring 100 having an outer threaded surface 102 is threadedly mounted within stator 30. Bearing adjusting ring 100 is used for adjusting the backlash or freeplay of bearing assembly 90 by exerting a pressure thereon adjusted by screwing or unscrewing bearing adjusting ring 100 in stator 30.

An O-ring seal 104 is mounted between stator 30 and bearing adjusting ring 100.

For locking bearing adjusting ring 100 in a given position relatively to stator 30, use is made of a slot 106 which extends parallely to the threads of adjusting ring 100. A bolt 108 is threadedly engaged in the adjusting ring 100 and by tightning bolt 108 the threads on the surface 102 are locked, preventing any further movement of adjusting ring 100. When an adjustment of bearing assembly 90 is required, the adjusting ring 100 may be difficult to rotate since it offers very little hold. Therefore, to rotate the adjusting ring 100, a block 110 (FIG. 4) is secured temporarily to the rotor 14 and a bolt 108 threadedly engaged in one of the holes of bearing seat 46. Block 110 comprises a radially projecting portion 112 which interferes with the head of bolt 108 when rotor 14 is rotated. By manually rotating the rotor 14 back and forth, the radially projecting portion 112 hammers on bolt 108 and turns bearing adjusting ring 100.

The grease fitting 88 (see FIG. 3) emerges under ball bearing assembly 90. Therefore, the grease pumped through grease fitting 88 is discharged radially inwardly off ball bearing assembly 90.

The circumferential surface 113 of rotor 14 is provided with a plurality of parallel peripheral grooves 114 for receiving a belt (not shown) for driving the rotor, the belt being driven by motor 16.

The stator 30 is provided with a plurality of threaded openings 116 extending around the periphery thereof and which are used to retain stator 30 to body 12 of the debarking machine.

Referring now to FIG. 7 the debarking machine 10 is provided with a cleaning knife 116 attached to body 12 and being pivotable in a plane normal to axis 32. In operative position, blade 116, as illustrated in full lines extends in front of tools 28 and is used to cut the bark fiber which sometimes remains attached to the tools. When the cleaning operation is terminated a knife 116 is brought back in its stored position as indicated in phantom lines.

Knife 116 may be pneumatically or hydraulically actuated by an hydraulic or pneumatic piston cylinder assembly 117 and is controlled manually by the operator of the machine through a switch on a relay which prevents an accidental actuation of the knife 116 when a log is being processed in the machine 10.

To scrape accumulated bark fiber on the circumferential inner wall of sleeve 70 of the rotor, a scraper 200 has a plate which extends longitudinally within the central opening. This plate has a side portion 202 which is securely mounted to side wall of body 10.

A hood 118 may also be mounted in front of rotor 14 for protection purposes. Hood 118 is secured to body 12 by bolts passing through holes 120 and comprises an opening 122 through which the logs to be debarked are passed. Also hood 118 is provided with a slot 124 through which extends cleaning knife 116.

The operation of the debarking machine 10 device is as follows;

Prior to the beginning of the debarking operation proper the rubber springs tensioning the tools 28 against the log surface have to be tensioned according to the ambiant temperature and other considerations which a man skilled in the art fully understands.

Firstly, the locking device 75 which maintains frame 72 in a given position relatively to rotor 14, must be released. This is achieved by removing bolt 77 from nuts 79 and 81. Subsequently, a hydraulic jack 118 is mounted between pin 86 and sleeve 52 of the adjacent crank 50 (see FIG. 6). Hydraulic jack 118 is preferably manually actuated and it forces apart pin 86 from sleeve 52 by slightly rotating frame 72 on rotor 40 against the rubber springs 87. When the desired degree of pretentioning is reached, the frame is fixed in this position by screwing bolt 77 back in nuts 79 and 81. The jack 118 is retracted and removed.

It some lubrication is necessary, grease may be injected in the rotor through grease fitting 88. Since the grease is discharged radially inwardly of bearing assembly 90, when the rotor is set in motion, the centrifugical force urges the grease to pass through the bearing assembly providing the necessary lubrication.

If an adjustment of the free play of bearing assembly 90 is required, block 110 is attached on rotor 14 by using one of the already existing holes thereon: Bolt 108 is slightly untightened for unlocking the bearing adjusting ring 100 from stator 30. Therefore, by grasping tools 28, the rotor is rotated back and forth, manually, and portion 112 of block 110 hammers on the head of bolt 108 and rotates the adjustment ring 100 in the desired direction. When the required degree of pressure on bearing assembly 90 is reached, bolt 108 is tightened for locking the adjustment nut and block 110 is removed.

Finally, the debarking machine is started and the feed device 26 is opened. An end of a log is brought between the feed rollers 26 which engages its surface and advances it towards rotor 14. Since the latter is set in rotation and the tools 28 are crescent-shaped, when the extremity of the log contacts the tools, they will drive themselves away from the log until the edges 34 of tools 28 engage the surface of the log.

If the bark fiber accumulates on the tools 28, the knife 116 is actuated by the operator and it swings from its stored position to its operative position whereby it cuts the bark fiber adhearing to the tools 28. Subsequently, knife 116 is brought back in its stored position and the debarking of another log may begin.

Whereas the invention has been described with reference to specific forms, it should not be interpreted as limiting in any sense except by the scope of the following claims.

The embodiments of the invention in which an exclusive property or privilege is claimed are defined as follows:

1. A debarking machine for removing bark from a log, comprising:

a frame supporting structure;

an annular rotor mounted to said structure rotatable about a first axis and defining a circular opening having a diameter of substantially 18 inches for receiving a log therethrough along said first axis;

an annular frame mounted on said rotor and being adapted for limited movement thereon;

frame locking means mounted on said rotor and cooperating with said annular frame for fixing said frame in a predetermined position relative to said rotor;

six bark-scraping tool assemblies mounted to said frame and equally spaced around the periphery of said opening, each bark scraping tool assembly including;

(a) a spindle rotatably mounted to said rotor about an axis substantially parallel to said first axis, said spindle being disposed adjacent to the periphery of said opening;

(b) a crank secured to an end of said spindle;

(c) a spring assembly interconnecting said crank and said frame for urging said crank towards said frame, said spring assembly including;

(i) a first spring holding finger mounted to said crank at a distance from said spindle;

(ii) a second spring holding finger mounted to said frame and being substantially parallel to said first spring holding finger; and (iii) at least one belt of rubber-like material mounted around said first and second spring holding fingers, whereby said belt is tensioned by displacing said frame relatively to said rotor in order to move said second spring-holding finger away from said first spring-holding finger;

(d) a rigid elongated crescent-shaped tool having an end secured to an opposite end of said spindle and an opposite end provided with a scraping edge, said tool being swingable along a plane substantially normal to said first axis between a first position wherein said bark scraping edge is adjacent to said first axis and a second position wherein said bark scraping edge is adjacent to the periphery of said opening, said spring assembly urging said tool towards said first position through the intermediary of said lever and said spindle against the surface of the log passing through the rotor;

driving means mounted on said body for rotating said rotor about said first axis; and log feed means mounted on said body for advancing longitudinally the log through said opening along said first axis said log feed means restraining said log from an excessive rotation about said first axis.

2. A debarking machine as defined in claim 1, further comprising a plate mounted to said structure and having a scraping portion extending within said circular opening of said rotor for removing accumulated bark fiber in said opening.

3. A debarking machine as defined in claim 1, wherein said rotor includes an annular member to which is attached a sleeve member in coaxial relationship, the bark scraping tool assemblies being mounted to said annular member.

4. A debarking machine as defined in claim 3, wherein said annular frame includes a ring-shaped member concentrically mounted on said sleeve member for rotating within close limits thereon, and further including a plurality of flanges extending radially and outwardly from said ring-shaped member and being attached thereto, said flanges facing said annular member, each flange being adjacent to a crank and carrying a second spring-holding finger mounted at a distance from said ring-shaped member, the second spring holding finger extending parallel to said first axis.

5. A debarking machine as defined in claim 1, wherein each spring assembly includes three belts of rubber-like material, said belts being grouped concentrically one relative to another.

6. A debarking machine as defined in claim 4, wherein said frame cooperates with guide means mounted on said annular member, said guide means retaining said frame on said sleeve and limiting, within close limits, the rotation of said frame relative to said annular member.

7. A debarking machine as defined in claim 4, wherein said guide means comprises a bracket attached to said annlar member, said bracket comprising an arcuate slot receiving a screw attached to said frame.

8. A debarking machine as defined in claim 4, further comrising:

first abuttment means mounted to said rotor at a point remote from said frame;

second abuttment means mounted to said frame, whereby a spring-tensioning telescopic hydraulic jack may be mounted between said first and second abuttment means for forcing said first and second abuttment means apart against the plurality of spring means for tensioning said plurality of spring means.

9. A debarking machine as defined in claim 8, wherein said first abuttment means is constituted by a tubular member formed on a crank and slidably receiving one end of a spindle, said second abuttment means being constituted by a pin mounted to a flange adjacent to the crank carrying said first abuttment means.

10. A debarking machine as defined in claim 1, wherein said frame locking means includes a first nut attached to said rotor, a second nut attached to said frame, and a bolt threadedly engaging said nuts.

11. A debarking machine as defined in claim 1, wherein each spring-holding finger is provided with an annular cap sitting on the belt passing around said each spring-holding finger for preventing an accidental removal of said belt.

12. A debarking machine as defined in claim 1, further comprising:

an annular state secured to said structure, said stator being coaxially mounted on said rotor;

bearing means mounted between said rotor and said stator, said bearing means allowing free rotation of rotor on said stator;

are adjusting ring having a threaded outer circumferential surface engaging mating threads formed on said stator, said adjusting ring being concentric to said rotor andssing on said bearing means, said outer surface comprising a slit extending parallel to the threads thereon; and a lock bolt threadedly engaged in said adjusting ring, said lock bolt passing perpendicularly through said slit, whereby, as said lock bolt is tightened, the threads on the outer surface of the adjusting ring in t region of said slit are slightly distorted in order to lock said adjusting ring in said stator.

13. A debarking machine as defined in claim 12, wherein said rotor further includes a grease fitting constituted by a conduit having one end accessible outside said rotor d an opposite end positioned inside said rotor between said first axis and said bearing means, said one end being adapted to receive a grease gun for injecting grease through said conduit inside said rotor whereb, as said rotor is set in rotation, the centifugical force urges said grease to pass through said bearing means.

14. A debarking machine as defined in claim 1, wherein each spindle is received in a circular bore on said rotor, each circular bore being parallel to said first axis; a removeable bearing seat being mounted at each end of saiore and being accessible outside said rotor, fastening means for retaining said seat on said rotor; the bearing seats carrying bearings associated with a bore in which a spindle is rotatably supported.

15. A debarking machine as defined in claim 1, further comprising a rotor cleaning device consisting of:

an elongated knife mounted to said structure and being adapted to pivot in a plane normal to said first axis between an operative position wherein said knife faces said opening of said rotor and is adjacent to the bark-scraping tools and a stored position wherein said knife is cleared of said opening; and actuating means mounted on said structure and cooperating with said knife for pivoting said knife between said operative and stored positions.

16. A rotor to be used on a debarking machine for removing the bark from a log, said rotor comprising:

an annular member to be rotated about a first axis, said member comprising an opening of substantially 18 inches in diameter for receiving a log therethrough along said axis;

a frame mounted on said member and adapted for limited movement thereon;

frame locking means mounted on said member and cooperating with said frame for fixing said frame in a predetermined position relatively to said member;

six bark scraping tool assemblies equally spaced about the periphery of said opening, said bark scraping tool assembly including:

(a) a spindle rotatably mounted to said annular member about an axis substantially parallel to saidfirst axis, said spindle being adjacent to the periphery of said opening;

(b) a crank secured to an end of said spindle;

(c) a spring assembly interconnecting said crank and said frame for urging said crank toward said frame, said spring assembly including:

(i) a first spring-holding finger mounted to said crank at a distance from a spindle;

(ii) a second spring-holding finger mounted to said frame and being substantially parallel to said first spring holding finger; and (iii) at least one belt of rubber-like material mounted around said first and second spring holding fingers, whereby said belt is tensioned by displacing said fframe relatively to said member in order to move said second spring-holding finger away from said first spring-holding finger;

(d) a rigid elongated crescent shaped tool having anend secured to an opposite end of said spindle and an opposite end provided with a scraping edge, said tool being swingable along a plane substantially normal to said first axis between a first position wherein said bark scraping edge is adjacent to said first axis and a second position wherein said bark scraping edge is adjacent to the periphery of said opening, said first position being limited by stop means mounted on said rotor, said spring assembly urging said tool towards said first position against the surface of the log passing through the rotor by the intermediate of said lever and said spindle.

17. A process to be performed on a debarking machine, said debarking machine being used for removing the bark from a log, said machine comprising:

a frame supporting structure;

a rotor mounted to said structure about a first axis and defining a circular opening having a diameter of substantially 18 inches for receiving a log therethrough along said first axis;

an annular frame mounted on said rotor and adapted for limited movement thereon;

frame locking means mounted on said rotor and cooperating with said annular frame for fixing said frame in a predetermined position relative to said rotor;

six bark-scraping tool assemblies, each including:

(a) a spindle rotatably mounted to said rotor about an axis substantially parallel to said first axis, said spindle being disposed adjacent to the periphery of said opening;

(b) a crank secured to an end of said spindle;

(c) a spring assembly interconnecting said crank and said frame for urging said crank towards said frame, said spring assembly including:

(i) a first spring-holding finger mounted to said crank at a distance from said spindle;

(ii) a second-spring holding finger mounted to said frame and being substantially parallel to said first spring holding finger; and (iii) at least one belt of rubber-like material mounted around said first and second spring holding fingers, whereby said belt is tensioned by displacing said frame relatively to said rotor in order to move said second spring-holding finger away from first spring-holding finger;

(d) a rigid elongated crescent-shaped tool having an end secured to an opposite end of said spindle and an opposite end provided with a scraping edge, said tool being swingable along a plane substantially normal to said first axis between a first position wherein said bark scraping edge is adjacent to said first axis and a second position wherein said bark scraping edge is adjacent to the periphery of said opening, said first position being limited by stop means mounted on said rotor, said spring assembly urging said tool towards said first position through the intermediary of said crank and said spindle against the surface of the log through the rotor;

driving means mounted on said body for rotating said rotor about said first axis;

log feed means mounted on said body for advancing longitudinally the log through said opening along said first axis, said log feed means restraining said log from an excessive rotation about said first axis;

first abuttment means mounted to said rotor at a point remote from said frame; and second abuttment means mounted to said frame, whereby a spring-tensioning telescopic hydraulic jack may be mounted between said first and second abuttment means for forcing said first and second abuttment means apart against the plurality of spring assemblies for tensioning said plurality of spring assemblies;

said process comprising through said slit, whereby, as said lock bolt is tightened, the threads on the outer surface of the adjusting ring in the region of said slit are slightly distorted in order to lock said adjusting ring in said stator.

18. A process to be performed on a debarking machine, said machine being used for removing the bark from a log, said machine comprising:

a frame supporting structure;

an annular stator secured to said structure;

a rotor adapted to rotate about a first axis and including a circular opening having a diameter of substantially 18 inches for receiving a log along said first axis, said rotor being coaxially mounted on said stator;

bearing means mounted between said rotor and said stator, said bearing means allowing said rotor to rotate freely on said stator;

an adjusting ring having a threaded outer circumferential surface engaging mating threads formed on said stator, said adjusting ring being concentric to said rotor and pressing on said bearing means; said outer surface comprising a slit extending parallel to the threads thereon; and a lock bolt threadedly engaged in said adjusting ring said lock bolt passing perpendicularly through said slit whereby, as said lock bolt is tightened, the threads on the outer surface of the adjusting ring in the region of said slit are slightly distorted in order to lock said adjusting ring in said stator;

a frame mounted on said rotor and adapted for limited movement thereon;

frame locking means mounted on said rotor and cooperating with said frame for fixing said frame in a predetermined position relatively to said rotor;

six bark-scraping tool assemblies equally spaced around the periphery of said opening, each bark scraping tool assembly including;

(a) a spindle rotatably mounted to said rotor about an axis substantially parallel to said first axis, said spindle being disposed adjacent to the periphery of said opening;

(b) a crank secured to an end of said spindle;

(c) a spring assembly mounted between said crank and said frame for urging said crank towards said frame, said spring assembly including;

(i) a first spring-holding finger mounted to said crank at a distance from said spindle;

(ii) a second spring-holding finger mounted to said frame and being substantially parallel to said first spring holding finger; and (iii) at least one belt of rubber-like material mounted around said first and second spring holding fingers, whereby said belt is tensioned by displacing said frame relatively to said rotor in order to move said second spring holding finger away from said first holding finger;

(d) a rigid elongated crescent-shaped tool having an end secured to an opposite end of said spindle and an opposite end provided with a scraping edge, said tool being swingable along a plane substantially normal to said first axis between a first position wherein said bark scraping edge is adjacent to said first axis and a second position wherein said bark scraping edge is adjacent to the periphery of said opening, said first position being limited by stop means mounted on said rotor, said spring assembly urging said tool towards said first position through the intermediate of said lever and said spindle against the surface of the long fed through the rotor;

driving means mounted on said body for rotating said rotor about said first axis;

log fed means mounted on said body for advancing longitudinally the log through said opening along said first axis, said log fed means restraining said log from an excessive rotation about said first axis, the method of adjusting the pressure on said ring shaped bearing means by rotating said bearing means adjusting ring;

said process comprising the steps of:

(a) loosening said lock bolt without removing the lock bolt from said adjusting ring;

(b) securing on said rotor a hammering block having a portion adapted to interfere with the lock bolt head when said rotor is rotated; and (c) rotating namually said rotor back and forth for successively striking said lock bolt head with said hammering block in order to rotate said adjusting ring until the desired degree of pressure on said bearing means is reached.

* * * * *